US011044793B2

(12) United States Patent
Kessels

(10) Patent No.: US 11,044,793 B2
(45) Date of Patent: Jun. 22, 2021

(54) LED LIGHTING CIRCUIT

(71) Applicant: Lumileds LLC, San Jose, CA (US)

(72) Inventor: Marc Kessels, Echt (NL)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 16/493,390

(22) PCT Filed: Mar. 7, 2018

(86) PCT No.: PCT/EP2018/055555
§ 371 (c)(1),
(2) Date: Sep. 12, 2019

(87) PCT Pub. No.: WO2018/166856
PCT Pub. Date: Sep. 20, 2018

(65) Prior Publication Data

US 2020/0077477 A1 Mar. 5, 2020

(30) Foreign Application Priority Data

Mar. 14, 2017 (EP) ..... 17160849

(51) Int. Cl.
*H05B 45/395* (2020.01)
*H05B 45/20* (2020.01)

(52) U.S. Cl.
CPC ..... *H05B 45/395* (2020.01); *H05B 45/20* (2020.01)

(58) Field of Classification Search
CPC ..... H05B 33/0803; H05B 33/0827; H05B 33/0809; H05B 33/0821; H05B 41/34; H05B 39/09; H05B 41/28; H05B 41/295; H05B 1/2827; H05B 41/3925; H05B 33/0815; H05B 33/0818; H05B 41/2828;
(Continued)

(56) References Cited

U.S. PATENT DOCUMENTS

2008/0272651 A1* 11/2008 Fong ..... H02J 1/08 307/31
2012/0223657 A1* 9/2012 Van de Ven ..... H05B 45/46 315/297

(Continued)

FOREIGN PATENT DOCUMENTS

WO 2008/135927 A1 11/2008

OTHER PUBLICATIONS

Ye Yuanmao et al: "Single-Switch Multichannel Current-Balancing LED Drive Circuits Based on Optimized SC Techniques", IEEE Transactions on Industrial Electronics, IEEE Service Center, Piscataway, NJ, USA, vol. 62, No. 8, Mar. 5, 2015 (Mar. 5, 2015), pp. 4761-4768, XP011585862, ISSN: 0278-0046, DOI: 10. 1109/TI E.2015 . 2408813.

(Continued)

*Primary Examiner* — Minh D A
(74) *Attorney, Agent, or Firm* — Volpe Koenig

(57) ABSTRACT

A lighting circuit and methods of manufacturing and controlling a lighting circuit are described. The lighting circuit includes a first array of semiconductor light sources, a separate second array of semiconductor light sources, and a shared array of semiconductor light sources. A first driver is electrically coupled to provide a first drive current to the first array and the shared array. A second driver is electrically coupled to provide a second drive current to the shared array and the second array.

12 Claims, 7 Drawing Sheets

(58) Field of Classification Search
CPC ..... H05B 41/3921; H05B 41/3927; H05B 37/029; H05B 37/0254; H05B 37/02; F21Y 2101/02; Y02B 20/202; A41D 27/085; A42B 1/242; G09F 21/02
See application file for complete search history.

(56) References Cited

U.S. PATENT DOCUMENTS

| | | | | |
|---|---|---|---|---|
| 2014/0333219 | A1* | 11/2014 | Zijlstra | H05B 45/37 315/192 |
| 2016/0205735 | A1* | 7/2016 | Heimes | H05B 45/395 315/77 |
| 2016/0260375 | A1* | 9/2016 | Ruan | G09G 3/3233 |
| 2016/0286615 | A1* | 9/2016 | Weeks, Jr. | H05B 45/22 |
| 2017/0064785 | A1* | 3/2017 | Kim | H05B 45/37 |

OTHER PUBLICATIONS

Wu Xinke et al: "Analysis and Design Considerations of LLCC Resonant Multioutput DC/DC LED Driver With Charge Balancing and Exchanging of Secondary Series Resonant Capacitors", IEEE Transactions on Power Electronics, Institute of Electrical and Electronics Engineers, USA, vol. 30, na. 2, Mar. 4, 2014 (Mar. 4, 2014), pp. 780-789, XP011560843, ISSN: 0885-8993, DOI:10. 1109/TPEL. 2014.2309605.

* cited by examiner

LED LIGHTING CIRCUIT

FIELD OF THE INVENTION

The invention describes an LED lighting circuit; a method of manufacturing such an LED lighting circuit; and a method of controlling such an LED lighting circuit.

BACKGROUND OF THE INVENTION

The ability to increase or decrease the colour temperature of white light is useful, with lower colour temperatures providing "warm" lighting, and higher colour temperatures providing a "cooler" light better suited for workplace lighting. The colour temperature of a conventional light source such as an incandescent lamp or a halogen lamp can be described by a black body locus in a chromaticity diagram of a colour space, and the colour temperature is generally expressed in degrees Kelvin.

Light-emitting diodes (LEDs) are being used to replace conventional light sources because of their low power consumption, long lifetime, and low cost. An LED light source generally comprises an array of LEDs, for example a string of LEDs or several strings connected in parallel, and a driver to supply the array with current. The driver current can be supplied as a constant DC current or—to reduce power consumption further—using a technique of pulse-width modulation. A single array is associated with a specific colour point or colour temperature. The light intensity of an array can be adjusted by increasing or decreasing the driver current as desired and/or by adjusting PWM (pulse-width modulation) parameters of the driver current.

An LED lamp that can output light of more than one colour requires at least two arrays, each with a different colour point. By regulating the current of each driver, it is possible to mix the colours and the intensities. For example, using three drivers for three LED arrays of different colour points, it is possible to obtain any colour within the colour gamut of that lighting circuit. However, while LED chips have become relatively cheap in recent years, the driver remains a significant cost factor for an LED lighting circuit. Therefore, it is still quite expensive to manufacture an LED lamp that mimics the dimming behaviour of an incandescent lamp. An LED lighting circuit that uses only two arrays—and therefore only two drivers—can only approximate the classic dimming behaviour of an incandescent lamp, since the transition from one colour temperature to the other must follow a straight line in the colour space, instead of a curved line like that of the black body locus. The dimming behaviour of such a prior art LED lighting circuit may therefore be perceived as "unnatural" by a consumer.

Therefore, it is an object of the invention to provide an alternative LED lighting circuit that overcomes the problems described above.

SUMMARY OF THE INVENTION

The object of the invention is achieved by the lighting circuit of claim 1; by the lighting unit of claim 6; by the method of claim 7 of manufacturing such a lighting circuit; and by the method of claim 12 of controlling such a lighting circuit.

According to the invention, the lighting circuit comprises a first array of semiconductor light sources and a separate second array of semiconductor light sources; a shared array of semiconductor light sources; a first driver arranged to drive the first array and the shared array; and a second driver arranged to drive the shared array and the second array.

An advantage of the inventive lighting circuit is that it can be controlled to behave as a lighting circuit that has three drivers, even though it only requires two drivers. This configuration of drivers and LED arrays makes it possible for the colour point of the light generated by the lighting circuit to follow any path—even a curved path—through a two-dimensional xy colour space, and at any level of luminous intensity. In contrast, a two-array lighting circuit with a separate driver for each array can only achieve a "straight line" locus through a colour space, and can only approximate a curved locus by a series of straight-line segments.

The inventive lighting unit or luminaire comprises such a lighting circuit. Depending on the choice of LEDs in each of the arrays, the inventive luminaire can precisely mimic the colour characteristics of a conventional light source such as an incandescent bulb.

According to the invention, the method of manufacturing such a lighting circuit comprises the steps of choosing a colour triangle within a colour space; determining colour points associated with the vertices of the colour triangle; selecting semiconductor light sources of the arrays on the basis of the colour points; arranging a first driver to drive the first array and the shared array; and arranging a second driver to drive the shared array and the second array.

According to the invention, the method of controlling such an LED lighting circuit comprises operating a driver according to a repeated control pattern, which control pattern specifies at least the amplitude and duration of the driver current during each period of the control pattern.

The dependent claims and the following description disclose particularly advantageous embodiments and features of the invention. Features of the embodiments may be combined as appropriate. Features described in the context of one claim category can apply equally to another claim category.

A semiconductor light source array can comprise any number of semiconductor light sources. A semiconductor light source of the inventive lighting circuit can be a light-emitting diode (LED) or laser diode (LD), or any other suitable semiconductor light source. In the following, but without restricting the invention in any way, it may be assumed that a semiconductor light source is an LED. Since the inventive lighting circuit may be used to mimic the light quality of an incandescent lamp or similar, in a preferred embodiment of the invention, one array comprises white LEDs and the other arrays comprise non-white LEDs that may be used to adjust the colour point of the total light output. Preferably, the LED colours for the three arrays are chosen by identifying a colour triangle in the colour space, so that the colour triangle at least partially encloses the black body locus. For example, the first LED array may comprise a set of white LEDs; the second LED array may comprise a set of orange LEDs, and the shared array may comprise a set of green LEDs. The LEDs of each array can be essentially identical LEDs, each with the same specific colour; alternatively, in a more economical approach, the LEDs of an array may be chosen to achieve—in combination—the desired colour. These can be controlled together, as will be explained in the following, to achieve essentially any shade of white along a black body locus in a colour space.

The first driver "feeds" the first LED array and the shared LED array, while the second driver "feeds" the shared LED array and the second LED array. To ensure that the current from a specific driver only drives its two arrays, the shared array preferably comprises two rectifying diode arrangements. A rectifying diode arrangement can comprise a single rectifying diode arranged between a driver and the light-emitting diodes of the shared array. Equally, such a rectifying diode arrangement can comprise two or more series-connected rectifying diodes, or two or more parallel-connected rectifying diodes. In other words, the cathode(s) of a rectifying diode arrangement are connected to the first anode of the LED string of the shared array. Each rectifying diode arrangement defines the direction of a current path from a driver through the LEDs of the shared array. In an alternative embodiment, a rectifying diode arrangement can be arranged between the last cathode of an LED array and the last cathode of the shared array. A rectifying diode arrangement can utilize LEDs to act as rectifying diodes. This may be preferred in the case that the LEDs are cheaper than comparable rectifying diodes.

Since the current provided by a driver is split between two arrays, in a preferred embodiment of the invention these are assembled to present matched arrays to their respective drivers. In other words, the diodes of each array are selected so that the sum of the forward voltages is the same for each array. This can be achieved in a number of ways. For example, the LED arrays can be matched by using the same number of diodes in each string, each with the same forward voltage. In an embodiment that uses rectifying diodes in the shared array, for example, the LEDs of the first array can be selected to arrive at the same total forward voltage as that of the shared array. The same applies to the second array.

Alternatively, the first array can incorporate a rectifying diode which serves no purpose other than to match the forward voltages of first array and the shared array. The rectifying diode can precede the string of LEDs, for example. The same applies to the second array, which can also include such a rectifying diode.

In the inventive method, the first driver is operated to inject a first current into the circuit portion comprising the first array and the shared array; the second driver is operated to inject a second current into the circuit portion comprising the shared array and the second array. Following this principle, the inventive lighting circuit allows a wide variety of control sequences. Since each driver drives the shared array, it is possible to operate the lighting circuit so that it behaves as if there were a "virtual" third driver present. When only the first driver is "on", the first array will receive approximately half of the first driver current, and the shared array will also receive approximately half of the first driver current. The two active arrays receive essentially the same current, while the LEDs of the second array receive no current. When only the second driver is "on", the second array will receive approximately half of the second driver current, and the shared array will also receive approximately half of the second driver current. The two active arrays receive essentially the same current, while the LEDs of the first array receive no current. A third effect can be achieved by operating both drivers simultaneously. During such an "overlap", the first array will receive approximately two thirds of the first driver current, the second array will receive approximately two thirds of the second driver current, and the shared array will receive approximately one-third of the first driver current as well as one-third of the second driver current.

Clearly, the colour contribution from the shared array can be adjusted in many ways. In a preferred embodiment of the invention, a control pattern is defined such that the first driver current overlaps the second driver current for an overlap duration. The length of the overlap duration and the non-overlap durations (when only one of the drivers is "on"), and the amplitudes of the first and second driver currents can be chosen for each part of a control pattern to achieve a specific desired colour and a specific luminous flux for the overall lighting circuit. A driver can be controlled to provide a constant current value for a set "on-time" duration, or it can be controlled using pulse-width modulation to rapidly switch between on and off states during an "on-time" duration.

A control sequence can apply a series of slightly different transitioning control patterns in order to achieve a gradual "motion" through the colour space, for example a motion that smoothly follows a locus such as a black body locus. In this way, a specific illumination behaviour can be achieved, for example to mimic the dimming behaviour of an incandescent lamp.

Other objects and features of the present invention will become apparent from the following detailed descriptions considered in conjunction with the accompanying drawings. It is to be understood, however, that the drawings are designed solely for the purposes of illustration and not as a definition of the limits of the invention.

BRIEF DESCRIPTION OF THE DRAWINGS

In the drawings, like numbers refer to like objects throughout. Objects in the diagrams are not necessarily drawn to scale.

DETAILED DESCRIPTION OF THE EMBODIMENTS

Figure 1:
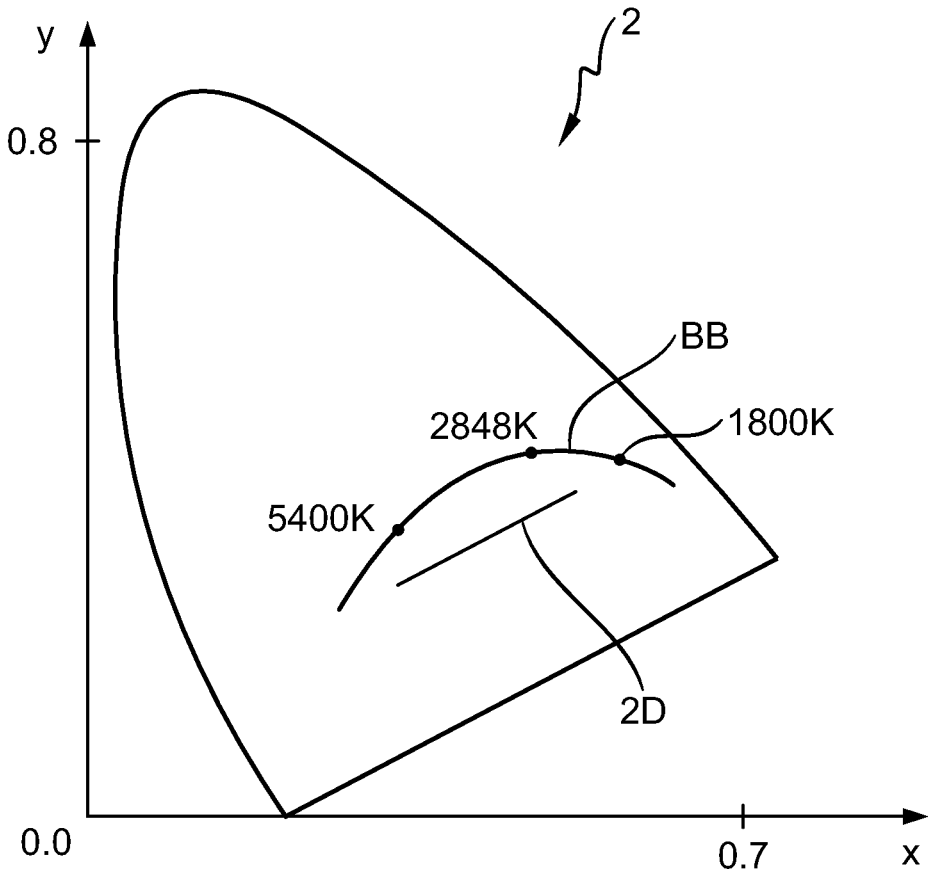
FIG. 1 shows a simplified CIE 1931 chromaticity space.

FIG. 1 shows—in a simplified manner—a chromaticity diagram or "slice" through a three-dimensional CIE 1931 colour space 2. The outer curved boundary represents the spectral locus. A black body locus BB or Planckian locus is shown, indicating some reference colour temperatures. This curve extends from a warm reddish colour like sunrise (1800 K) through a yellowish white like that of an incandescent lamp (2848 K) and a daylight white (5400 K) to blue-white (infinity). When a white light source such as a dimmable incandescent lamp is controlled to increase or decrease its brightness, the colour of its light output will essentially follow the black body locus BB. A prior art LED lamp can achieve an approximation of this behaviour by using two LED strings, each string having a different colour point, whereby the two colour points are chosen to correspond to the end points of the straight line 2D indicated in the diagram. The colour locus of such a lighting circuit is defined by the straight line 2D. However, the difference between this straight line and the curved black body locus BB can be perceived by an observer, and may be considered irritating or unpleasant, since the light source is not behaving in an "expected" manner.

Figure 2:
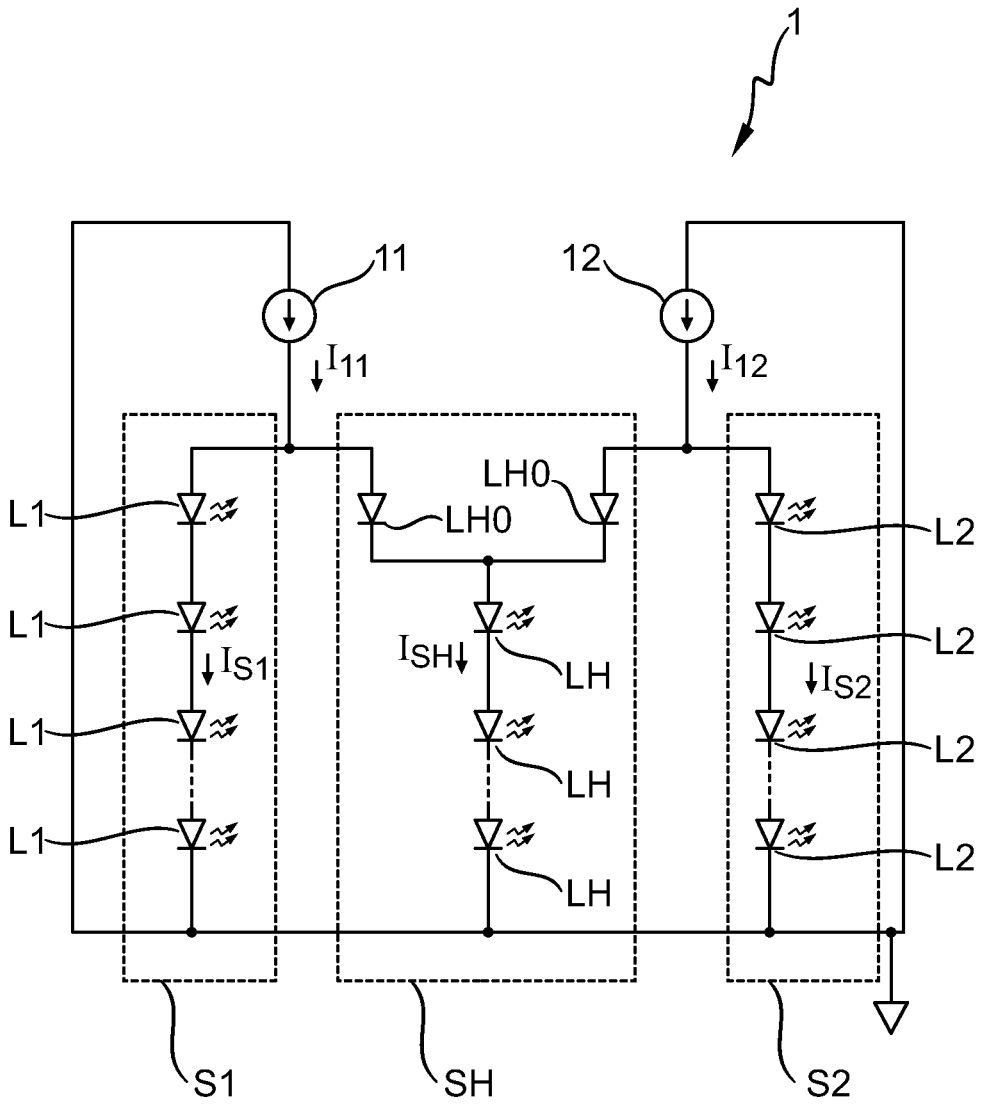
FIG. 2 shows a first embodiment of the inventive lighting circuit.

FIG. 2 shows a first embodiment of the inventive lighting circuit 1. Here, there are three arrays S1, SH, S2 of LEDs L1, LH, L2 arranged so that a first driver 11 drives a first array S1 and also a shared array SH, and a second driver 12 drives a second array S2 and also the shared array SH.

In this embodiment, the first LED array S1 comprises a string of series-connected light-emitting diodes L1, and the second LED array S2 comprises the same number of series-connected light-emitting diodes L2. The arrays S1, S2 are matched, i.e. the sum of the forward voltages of the LEDs L1, L2 of each array S1, S2 is essentially the same.

The shared array SH has two rectifying LEDs LH0 preceding the string of series-connected LEDs LH. Each rectifying LED LH0 is connected between one of the drivers 11, 12 and the shared array SH. The series-connected string of the shared array SH has (at least) one less LED than each of the first or second strings S1, S2. The two rectifying LEDs LH0 are matched, i.e. the forward voltages of these two rectifying LEDs LH0 are essentially identical. Furthermore, the rectifying LEDs LH, LH0 are chosen so that the sum of the forward voltages in a string comprising one of the rectifying LEDs LH0 and the series-connected LEDs LH is the same as the sum of the forward voltages of the LEDs of the first string S1 (and therefore also the same as the sum of the forward voltages of the LEDs of the second string S2).

Figure 3:
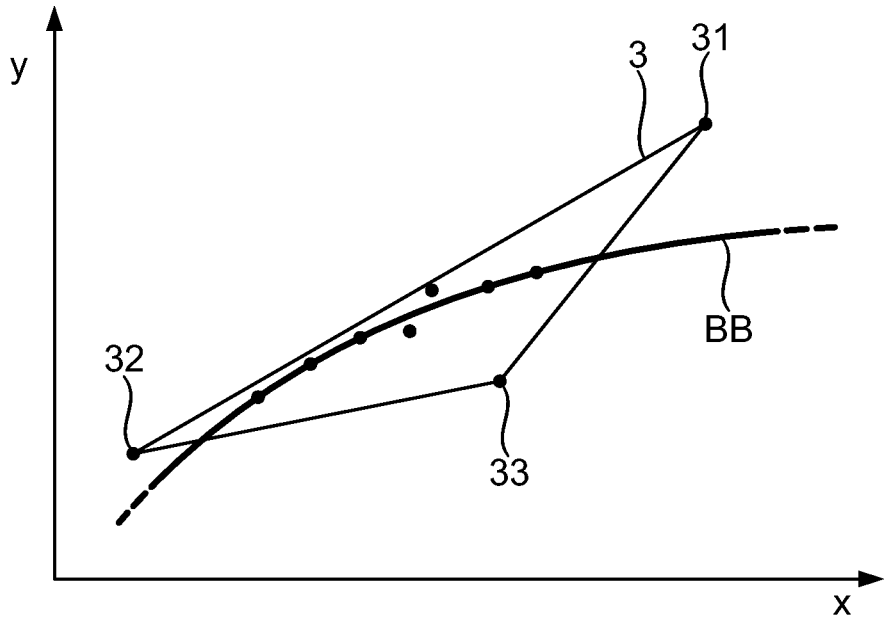
FIG. 3 shows a colour triangle determined by the inventive method.

The lighting circuit can generate a specific colour that lies on the black body locus BB described in FIG. 1 above. This is achieved by a specific choice of colour points of the LEDs L1, L2, LH, LH0 of the strings S1, S2, SH, and by operating each driver 11, 12 to generate a specific current level. The colour points (or colour temperatures) of the LEDs L1, L2, LH, LH0 of the strings S1, S2, SH are chosen to define a bounding "colour triangle" 3 as shown in FIG. 3. This diagram shows a part of the colour space of FIG. 1 along with the corresponding section of the black body locus BB. The bounding triangle 3 is defined by three vertices 31, 32, 33 and represents the gamut of that lighting circuit. The coordinates of a vertex correspond to the colour point of an LED array S1, S2, SH. By appropriate choice of colour point for each array S1, S2, SH, it is possible to define a specific triangle 3 that encloses a desired portion of the black body locus BB.

The first driver 11 provides a driver current $I_{11}$ that is divided between the first array S1 and the shared array SH, while the second driver 12 provides a driver current $I_{12}$ that is divided between the shared array SH and the second array S2. When both drivers are "on", the current $I_{S1}$ through the first array S1 is two thirds of the first driver current $I_{11}$; the current $I_{S2}$ through the second array S2 is two thirds of the second driver current $I_{12}$; and the current $I_{SH}$ through the shared array SH is one third of the first driver current $I_{11}$ plus one third of the second driver current $I_{12}$.

When only one of the two drivers is "on", the current from that driver is shared equally between two strings. For example, when the first driver 11 is "on" and the second driver 12 is "off", the current $I_{S1}$ through the first array S1 is one half of the first driver current $I_{11}$; the current $I_{S2}$ through the second array S2 is 0; and the current $I_{SH}$ through the shared array SH is also one half of the first driver current $I_{11}$. Due to the non-linear behaviour of a diode, as will be known to the skilled person, the currents $I_{S1}$, $I_{S2}$, $I_{SH}$ drawn by the LED strings S1, S2, SH will not be exactly one-third, one half etc. of the driver current $I_{11}$, $I_{12}$.

By appropriately operating the drivers 11, 12 to generate a specific combination of first current $I_{11}$ and second current $I_{12}$, the light output by the lighting circuit can follow the black body locus BB while the lamp is being dimmed or when its brightness is being increased. Possible "colours" of an exemplary lighting circuit are shown as dots lying close to or on the black body locus BB. Any colour within the colour triangle 3 is possible.

Figure 4:
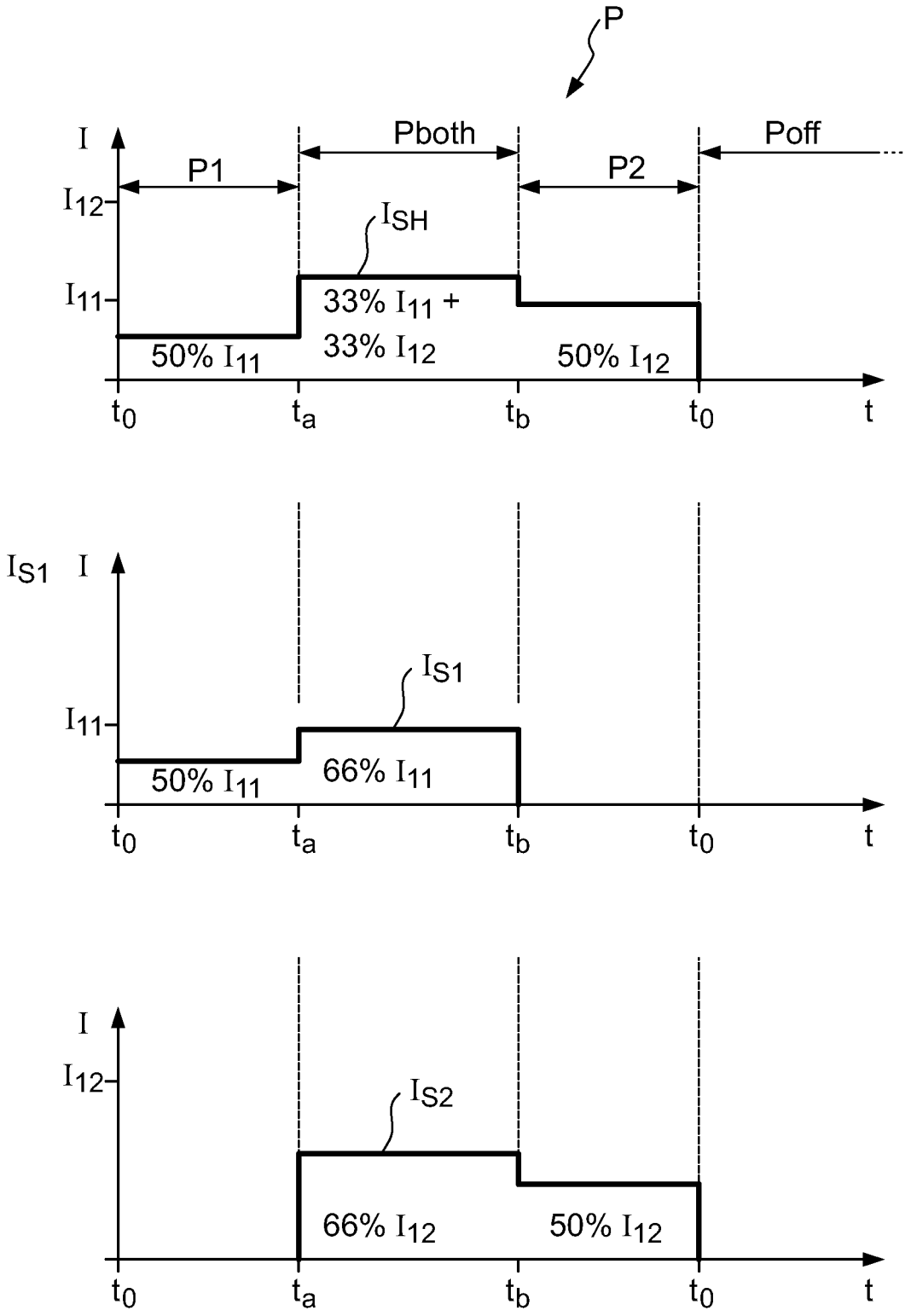
FIG. 4 shows an exemplary control pattern for the inventive lighting circuit.

FIG. 4 is a simplified schematic of current I (in mA) against time (in ms) showing how the strings S1, S2, SH may be activated and deactivated according to successive periods $P_1$, $P_2$, $P_{both}$, $P_{off}$ of an exemplary specific control pattern P. The upper part of the diagram shows the current $I_{SH}$ through the shared string SH of FIG. 2, the middle part of the diagram shows the current $I_{S1}$ through the first string, and the lower part of the diagram shows the current $I_{S2}$ through the second string. The first driver delivers a first current $I_{11}$ from time t0 to time tb, and the second driver delivers a second current $I_{12}$ from time ta to time tc. From time $t_a$ to time $t_b$, the shared string SH is being fed with current from both the first and second drivers.

When only the first driver is "on" in period $P_1$, the current $I_{S1}$ through the first array is approximately 50% of the first driver current $I_{11}$, and the current $I_{SH}$ through the shared array is also approximately 50% of the first driver current $I_{11}$. In this period $P_1$, the LEDs of the second array receive no current.

When both drivers are "on" in period $P_{both}$, the current $I_{S1}$ through the first array is approximately 66% of the first driver current $I_{11}$, the current $I_{S2}$ through the second array is approximately 66% of the second driver current $I_{12}$, and the current $I_{SH}$ through the shared array is given by the sum of approximately 33% of the first driver current $I_{11}$ and approximately 33% of the second driver current $I_{12}$ When only the second driver is "on" in period $P_2$, the current $I_{S2}$ through the second array is approximately 50% of the second driver current $I_{12}$, and the current $I_{SH}$ through the shared array is also approximately 50% of the second driver current $I_{12}$. In this period $P_2$, the LEDs of the first array receive no current.

The control pattern P can persist for a desired length of time and may be preceded by and followed by other suitable control patterns of a dimming sequence, a colour adjustment sequence, etc. A control pattern P can include an "off" period $P_{off}$ in which both drivers are off, for example. The current levels $I_{11}$, $I_{12}$ of the drivers and the duration of periods $P_1$, $P_2$, $P_{both}$, $P_{off}$ of each control sequence can be carefully chosen to achieve the desired colour as well as the desired intensity. Of course, the control sequence shown in FIG. 4 is only exemplary, and it will be understood that any sequence of active driver currents and on/off times is possible.

Figure 5:
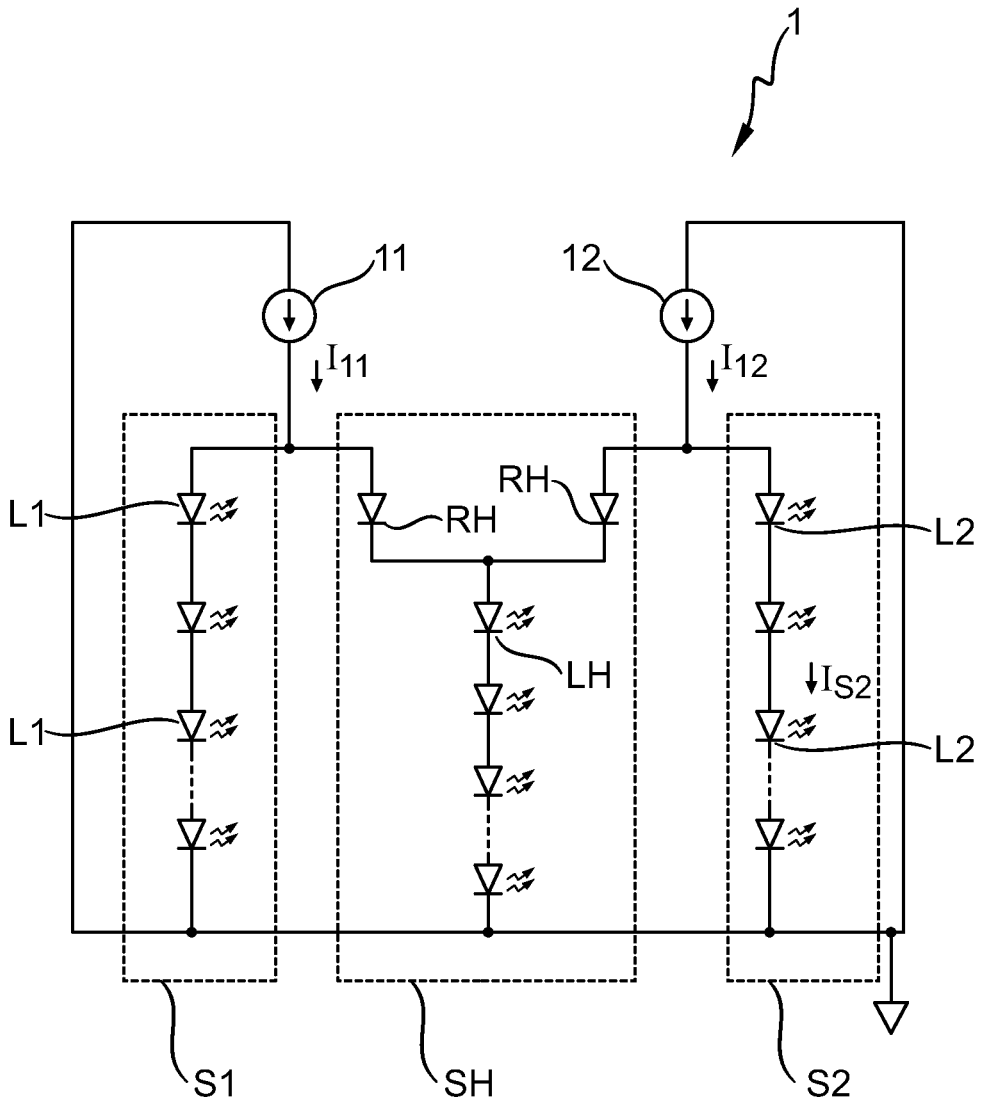
FIG. 5 shows a second embodiment of the inventive lighting circuit.

FIG. 5 shows a second embodiment of the inventive lighting circuit 1. It is similar to that of FIG. 2, and only the difference is explained here: Instead of the rectifying LEDs LH0 of FIG. 2, the shared array SH has two rectifying diodes RH at the beginning of the string of series-connected LEDs LH. The rectifying diodes RH are matched, i.e. the forward voltages of these two diodes RH are essentially identical. Furthermore, the LEDs L1, L2, LH and diodes RH are chosen so that the total forward voltage is essentially the same for each array S1, S2, SH. If the rectifying diodes RH are near-ideal, i.e. with near-zero forward voltage, the shared string SH can comprise an additional LED as indicated in the diagram.

In this embodiment also, the colour points of the LEDs L1, L2, LH can be chosen to define a colour triangle as explained in FIG. 3 above, and the drivers 11, 12 can be operated to drive the LED arrays S1, S2, SH to generate a specific colour within the colour triangle, or to make the colour follow the black body locus BB.

Figure 6:
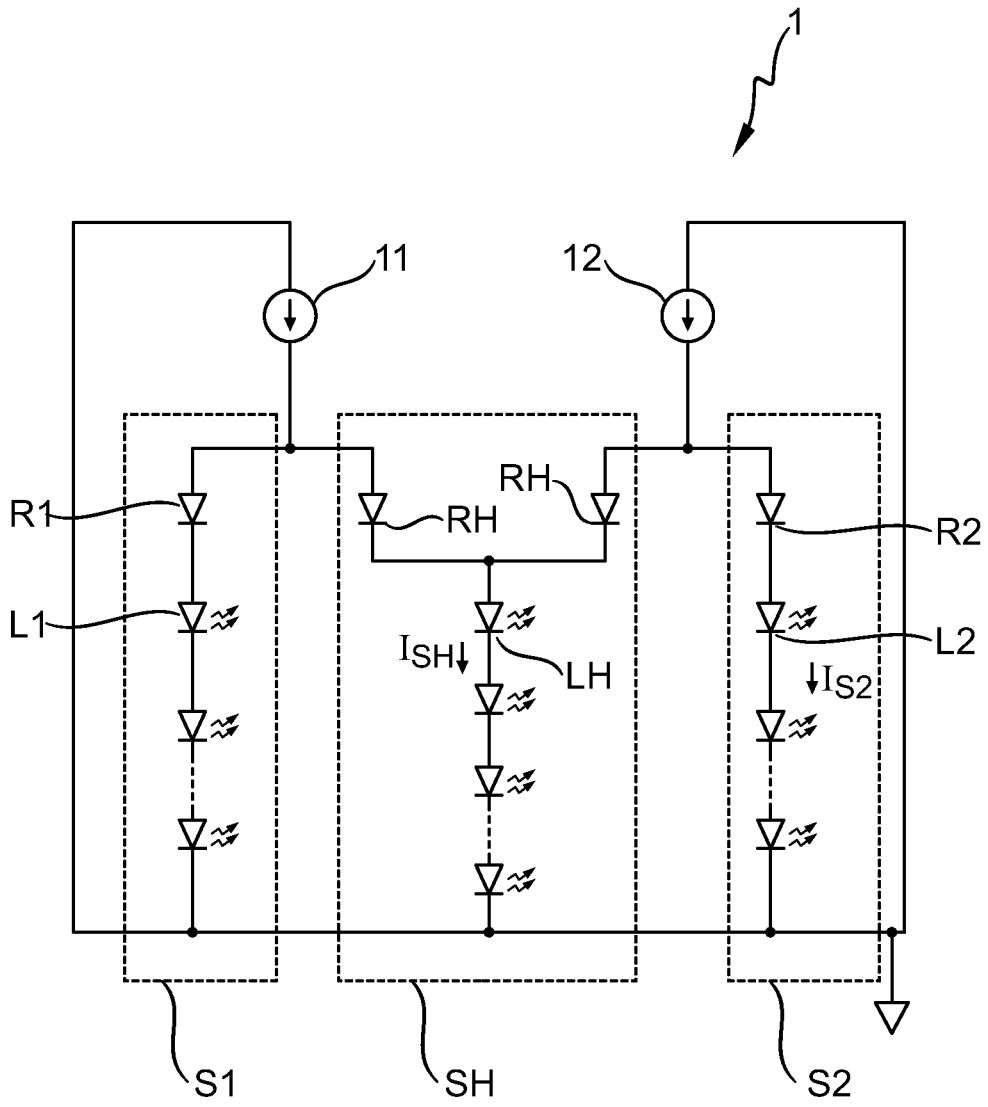
FIG. 6 shows a third embodiment of the inventive lighting circuit.

FIG. 6 shows a third embodiment of the inventive lighting circuit 1. It is similar to that of FIG. 5, and only the difference is explained here: Each of the first and second strings S1, S2 includes a rectifying diode R1, R2 at the beginning of the string of series-connected LEDs L1, L2. This makes it easier to match the forward voltages of the strings S1, S2, SH, and is a more economical realisation since rectifying diodes are generally very cheap components. Here also, the colour points of the LEDs L1, L2, LH can be chosen to define a colour triangle as explained in FIG. 3 above, and the drivers 11, 12 can be operated to drive the LED arrays S1, S2, SH to generate a specific colour inside the colour triangle, or to make the colour follow the black body locus BB as the lamp is being dimmed or brightened.

Figure 7:
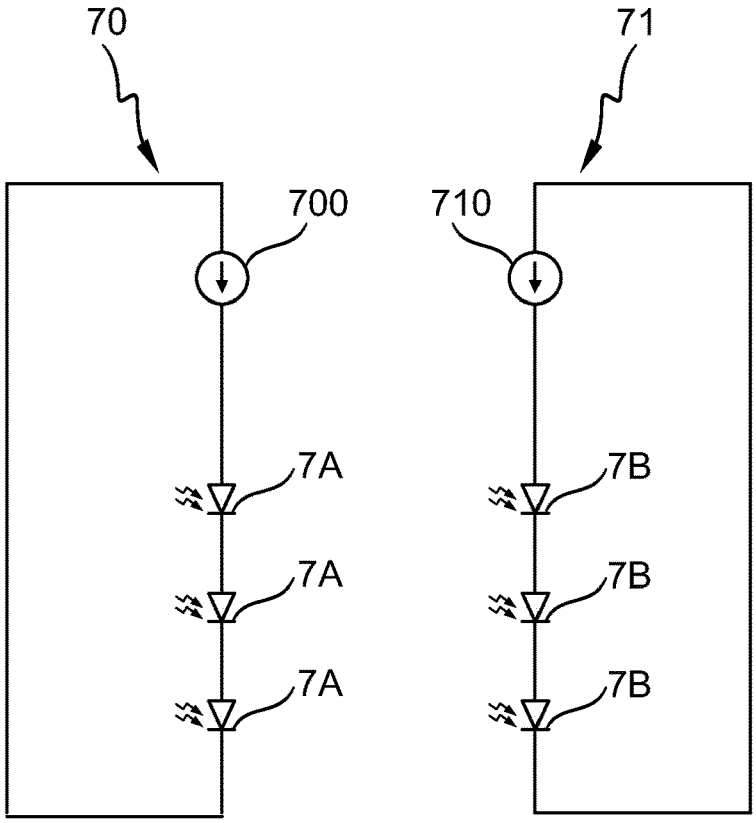
FIG. 7 (prior art)
FIG. 7 and FIG. 8 show prior art lighting circuits.

FIG. 7 shows a prior art lighting circuit with two LED arrays. Here, two separate circuits 70, 71 are required. A first circuit 70 has a first driver 700 and a string of LEDs 7A of a first colour. A second circuit 71 has a second driver 710 and a string of LEDs 7B of a second colour. A driver 700, 710 can only adjust the light output of its own LED string by increasing or decreasing the driver current amplitude, by adjusting PWM parameters, etc. The colour space locus achievable using such a circuit will follow a straight line 2D as shown in FIG. 1. This prior art realisation is therefore unsuitable for mimicking the colour behaviour of an incandescent lamp.

Figure 8:
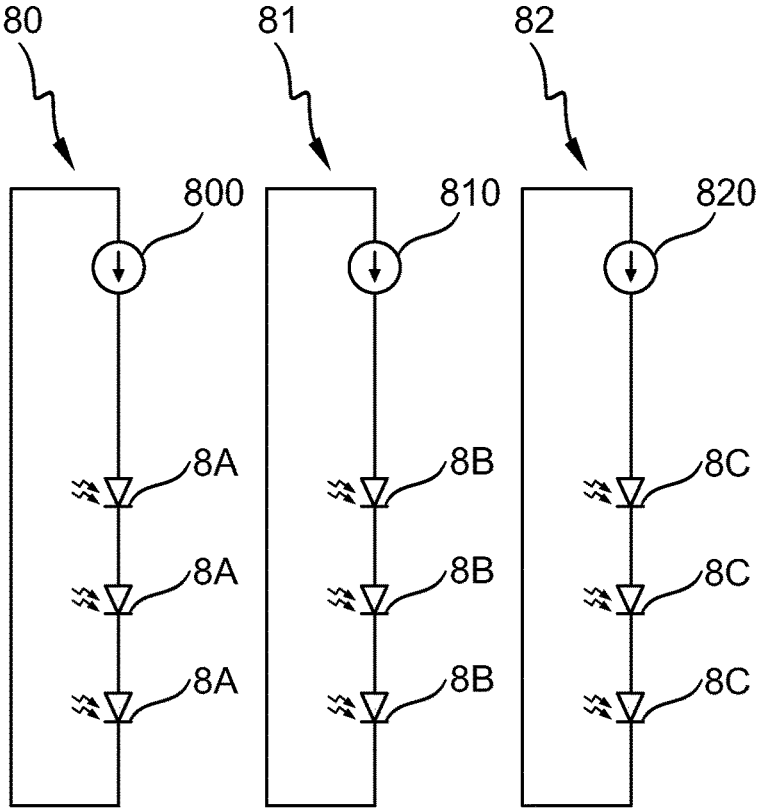
FIG. 8 (prior art)

FIG. 8 shows another prior art lighting circuit. Here, three separate circuits 80, 81, 82 are required. A first circuit 80 has a first driver 800 and a string of LEDs 8A of a first colour. A second circuit 81 has a second driver 810 and a string of LEDs 8B of a second colour. A third circuit 82 has a third driver 820 and a string of LEDs 8C of a third colour. The colour space locus achievable using such a circuit can follow a black body locus, but at the cost of an additional third driver. This prior art realisation is therefore unfavourably expensive.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements.

REFERENCE SIGNS lighting circuit 1
driver 11, 12
colour space 2
colour triangle 3
vertex 31, 32, 33
LED array S1, S2, SH
driver current $I_{11}$, $I_{12}$
array current $I_{S1}$, $I_{S2}$, $I_{SH}$
light-emitting diode L1, L2, LH, LH0
rectifying diode RH, R1, R2
control pattern P
duration $P_1$, $P_2$, $P_{both}$, $P_{off}$
black-body locus BB
straight locus 2D
time t0, ta, tb
prior art circuit 70, 71
prior art driver 700, 710
prior art circuit 80, 81, 82
prior art driver 800, 810, 820

The invention claimed is:

1. A lighting circuit comprising: a first array of semiconductor light sources and a separate second array of semiconductor light sources; a shared array of semiconductor light sources; a first rectifying diode circuit between the shared array of semiconductor light sources and the first array of semiconductor light sources; a second rectifying diode circuit between the shared array of semiconductor light sources and the separate second array of semiconductor light sources, the first and second rectifying diode circuits each comprising a single rectifying diode; a first driver directly connected to an anode of the first array of semiconductor light sources and an anode of the first rectifying diode circuit to provide a first drive current to the first array and the shared array; and a second driver directly connected to an anode of the second rectifying diode circuit and an anode of the separate second array of semiconductor light sources electrically coupled to provide a second drive current to the shared array and the second array, the first, second and shared arrays having matched forward voltages.

2. The lighting circuit according to claim 1, wherein one of the first, second and shared arrays of semiconductor light sources comprises white LEDs, and the other two of the first, second and shared arrays of semiconductor light sources comprise non-white LEDs.

3. The lighting circuit according to claim 1, wherein:

the first array of semiconductor light sources comprises a first series string of light-emitting diodes, the second array of semiconductor light sources comprises a second series string of light-emitting diodes, and the shared array of semiconductor light sources comprises a third series string of light-emitting diodes, a first rectifier diode coupled in series between the third series string of light-emitting diodes and the first series string of light emitting diodes, and a second rectifier diode coupled in series between the third series string of light-emitting diodes and the second series string of light emitting diodes.

4. The lighting circuit according to claim 3, wherein the first, second and third series strings of light-emitting diodes comprise the same number of light-emitting diodes.

5. The lighting circuit of claim 3, wherein the first and second rectifier diodes are rectifier light-emitting diodes.

6. The lighting circuit of claim 5, wherein the first and second series strings of light-emitting diodes comprise more light-emitting diodes than the third series string of light-emitting diodes.

7. The lighting circuit of claim 3, wherein the first array of semiconductor light sources comprises a third rectifier diode, and the second array of semiconductor light sources comprises a fourth rectifier diode.

8. The lighting circuit of claim 1, wherein the first drive current and the second drive current are direct current (DC) currents.

9. A method of controlling a lighting circuit, the method comprising: operating a first driver according to a repeated control pattern that specifies at least the amplitude and duration of a first current through a first semiconductor light source array during each period of the control pattern to supply the first current to the first semiconductor light source array and a shared semiconductor light source array, a first rectifying diode circuit being disposed between the shared array and the first array, the first driver being directly connected to an anode of the first array and an anode of the first rectifying diode circuit; and operating a second driver according to the repeated control pattern that specifies at least the amplitude and duration of a second current through a second semiconductor light source array during each period of the control pattern to supply the second current to the second semiconductor light source array and a shared semiconductor light source array, a second rectifying diode circuit being disposed between the shared array and the second array, the first and second rectifying diode circuits each comprising a single rectifying diode, the second driver being directly connected to an anode of the second rectifying diode circuit and an anode of the second array, and the first, second and shared arrays of semiconductor light sources having matched forward voltages.

10. The method according to claim 9, further comprising defining a control pattern such that the first current overlaps the second current for an overlap duration.

11. The method according to claim 9, further comprising defining the control pattern on the basis of a specific locus through a colour space.

12. The method according to claim 9, wherein the first drive current and the second drive current are direct current (DC) currents.

* * * * *